US006823641B2

(12) United States Patent
Grunst

(10) Patent No.: US 6,823,641 B2
(45) Date of Patent: Nov. 30, 2004

(54) METHODS AND STRUCTURES FOR SEALING AIR GAPS IN A BUILDING

(76) Inventor: Kenneth D. Grunst, 12017 Trailridge Dr., Potomac, MD (US) 20854

( * ) Notice: Subject to any disclaimer, the term of this patent is extended or adjusted under 35 U.S.C. 154(b) by 0 days.

(21) Appl. No.: 10/654,004

(22) Filed: Sep. 4, 2003

(65) Prior Publication Data

US 2004/0040241 A1 Mar. 4, 2004

Related U.S. Application Data

(62) Division of application No. 09/865,472, filed on May 29, 2001, now Pat. No. 6,651,402.
(60) Provisional application No. 60/208,916, filed on Jun. 5, 2000.

(51) Int. Cl.[7] ..... E04B 1/00
(52) U.S. Cl. ..... 52/741.4; 52/309.5; 52/741.1; 52/742.13
(58) Field of Search ..... 52/214, 204.69, 52/204.705, 309.1, 309.5, 395, 716.6, 198, 747.1, 287.1, 254, 255, 742.13; 427/444

(56) References Cited

U.S. PATENT DOCUMENTS

| | | | |
|---|---|---|---|
| 4,244,901 | A | 1/1981 | Wencley et al. |
| 4,601,144 | A | 7/1986 | Tinti |
| 4,696,138 | A | 9/1987 | Bullock |
| 4,944,126 | A | 7/1990 | King |
| 5,000,361 | A | 3/1991 | Briddell et al. |
| 5,271,198 | A | 12/1993 | Freeman |
| 5,544,457 | A | 8/1996 | Labrecque |
| 5,546,714 | A | 8/1996 | Kenkel |
| 5,633,048 | A | 5/1997 | Bodin |
| 5,694,722 | A | 12/1997 | Husting et al. |
| 5,787,651 | A | 8/1998 | Horn et al. |
| 5,890,845 | A | 4/1999 | Buonaiuto et al. |
| 5,916,394 | A | 6/1999 | Prochaska et al. |
| 5,927,032 | A | 7/1999 | Record |

(List continued on next page.)

FOREIGN PATENT DOCUMENTS

| | | |
|---|---|---|
| CH | 671999 | 10/1989 |
| DE | 3306482 | 9/1983 |
| GB | 2049777 | 12/1980 |
| GB | 2214960 | 9/1989 |

OTHER PUBLICATIONS

"BOSS 399 Silicone Glazing Sealant", BOSS Product Information, BOSS Products, Elizabethtown, KY.

(List continued on next page.)

*Primary Examiner*—Carl D. Friedman
*Assistant Examiner*—Chi Q. Nguyen
(74) *Attorney, Agent, or Firm*—Jeffrey S. Melcher; Manelli Denison & Selter, PLLC

(57) ABSTRACT

Provided is a seal structure for sealing an air gap between a framing member and a wallboard. The seal structure is formed from a curable, flowable material. The seal structure has a body having first and second opposing surfaces and a plurality of flexible seal members integral with and extending generally transversely with respect to a second surface of the body. The seal members are disposed in spaced relation to define a double seal between the framing member and the wallboard when the wallboard engages distal ends of the seal members. Also provided is a preformed seal structure. The invention further provides a method of sealing air gaps in an attic using an elastomeric paint to fill gaps of ⅛ inch.

28 Claims, 8 Drawing Sheets

U.S. PATENT DOCUMENTS

| | | | |
|---|---|---|---|
| 6,067,759 | A | 5/2000 | House |
| 6,168,208 | B1 | 1/2001 | Thaler |
| 6,245,179 | B1 | 6/2001 | Arnold et al. |
| 6,332,926 | B1 | 12/2001 | Pfaendtner et al. |
| 6,354,051 | B1 | 3/2002 | O'Hagin |
| 6,374,559 | B1 | 4/2002 | Rutherford |
| 6,405,508 | B1 | 6/2002 | Jenesky |

OTHER PUBLICATIONS

"Elastomeric Ceramic with Urethane Ultra Kote Protective Coating", Product Data #4025, Nationwide, Sept. 1, 1997.

"Elastomeric Permapatch Waterproofing Caulk & Sealant", Product Data #7540, Nationwide, Jan. 1, 1998.

"Consumer Energy Information: EREC Reference Briefs: Air Tight Drywall and Simple Caulk and Seal for Air Movement Control", updated Mar. 2000.

"DIY Workshop: Installing, Finishing and Repairing Drywall", see section entitled "Attaching Panels—The Finer Points", USG Corporation, 1996.

METHODS AND STRUCTURES FOR SEALING AIR GAPS IN A BUILDING

This application is a Divisional Application of U.S. application Ser. No. 09/865,472, filed on May 29, 2001 now U.S. Pat. No. 6,651,402, which claims priority to U.S. Ser. No. 60/208,916, filed on Jun. 5, 2000, the complete disclosures of which are incorporated herein by reference.

FIELD OF THE INVENTION

This invention relates to sealing air gaps in the houses and commercial buildings to reduce energy loss due to air leakage through the gaps.

BACKGROUND OF THE INVENTION

Many experts believe that 40% or more of energy loss in a home is due to air leakage. Some of that energy loss is due to wind, and some is due to the atmospheric pressure differences between the inside and the outside of the building. A significant portion of the air leakage is due to the "chimney effect" or the escape of rising heated air from the house into the attic. Air escapes through gaps that are virtually invisible, so few people even know that the gaps are present, let alone, how to seal the gaps. Specifically, there are gaps between the top plates of framed walls and the drywall that is installed against them. These gaps occur because of the imperfect fit and irregular size of the framing members. The gaps occur in all interior and exterior walls and on both sides of the interior walls. Since the gaps are often 1/16"–1/8" or more in thickness, and may occur in literally hundreds of running feet of walls at the intersection with the attic, the net effect is a huge breach through which conditioned air escapes. Surprisingly, these gaps are virtually never sealed during the new home construction process. In fact, when typical new homes are tested with a Blower Door for air leakage, the volume of air lost through these spaces into the attic can be as much as 2 to 3 total air changes per day, or roughly equivalent to leaving a double hung window open 4 to 5 inches or more on a cold winter day. The attic insulation above these gaps provides no defense. In spite of the high "R-value" of fiberglass, it does not stop air movement through it. Therefore, virtually every house in the U.S. was (and still is) built with pathways for continuous loss of air into the attic and covered with insulation that is ineffective in stopping the air movement.

Conventional methods employed to reduce this energy loss include dispensing an unshaped bead of caulk and allowing it to cure before the drywall is installed. This bead is highly ineffective since it becomes very rigid and creates wider voids than a wall without the bead. The bead is also objectionable to builders and drywall installers since it may not enable the desirable close fit of wallboards.

Another approach to seal gaps from the home into the attic is to apply a bead of mastic or standard caulking and to install the drywall before the bead hardens. However, this bead is often non-existent after the drywall is installed. When the drywall is slid up the wall and into position during installation, the leading edge of the drywall wipes away most of the sealant bead and it remains on the edge of the drywall (in a totally ineffective location) rather than behind the drywall where it needs to be. Attempts to change the installation habits of drywall hangers to preserve the bead have been unsuccessful. The installers claim that the drywall sheets are too heavy and awkward to gently place them against the wall, and then hold them steady long enough to nail them into position without disrupting an uncured bead of caulk.

Still another sealing method to seal gaps from the home into the attic is to use a commercially available foam tape or weather strip instead of the bead of caulk. However, this method is ineffective since the drywall doesn't slide over the blunt edge of the weatherstrip tape. Instead the tape is sheared loose from the top plate by the drywall being slid into place and is never replaced. It is unreasonable to expect that a drywall Installer, being paid on a piece-work basis, would reattach every piece of weather strip that tears loose. In most cases, the tape simply "disappears" or remains on the leading edge of the drywall, and the homeowner is the loser, because the homeowner does not receive the energy saving device the owner thought he or she was buying.

Accordingly, there is a need to provide a method and structure to seal the air gaps in houses and commercial buildings to reduce the energy losses associated with air leaking through unsealed air gaps into the attic.

SUMMARY OF THE INVENTION

An object of the invention is to fulfill the need referred to above. In accordance with the principles of the present invention, this objective is obtained by providing a seal structure for sealing an air gap between a framing member and a wallboard. The seal structure is formed on site from a curable, flowable material and includes a body having first and second opposing surfaces. The first surface of the body is constructed and arranged to be bonded to the member. Two or three flexible seal members are integral with and extend generally transversely with respect to the second surface of the body. The seal members are disposed in spaced relation to define a double or triple seal between the framing member and the wallboard when the wallboard engages distal ends of the seal members.

Another object of the invention is to provide a method of sealing an airspace between a member and wallboard. The method includes placing a seal structure on the member. The preferred seal structure comprising an elongated body and two or three seal members integral with and extending generally transversely with respect to a surface of the body. The seal members are flexible and disposed in spaced relation. A wallboard is placed in contact with distal ends of the seal members to defined two or three seals between the wallboard and the member.

Yet another object of the invention is to provide a method of sealing an air gap between a member and a wallboard. The method includes spraying a flexible sealant under pressure into the air gap to fill the air gap.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

FIGS. 4a1 through 4a4 and 4b1 through 4b3 show two nozzles for defining a seal structure and an end view of a seal structure of the invention;

DETAILED DESCRIPTION OF THE PRESENTLY PREFERRED EXEMPLARY EMBODIMENTS

Figure 1:
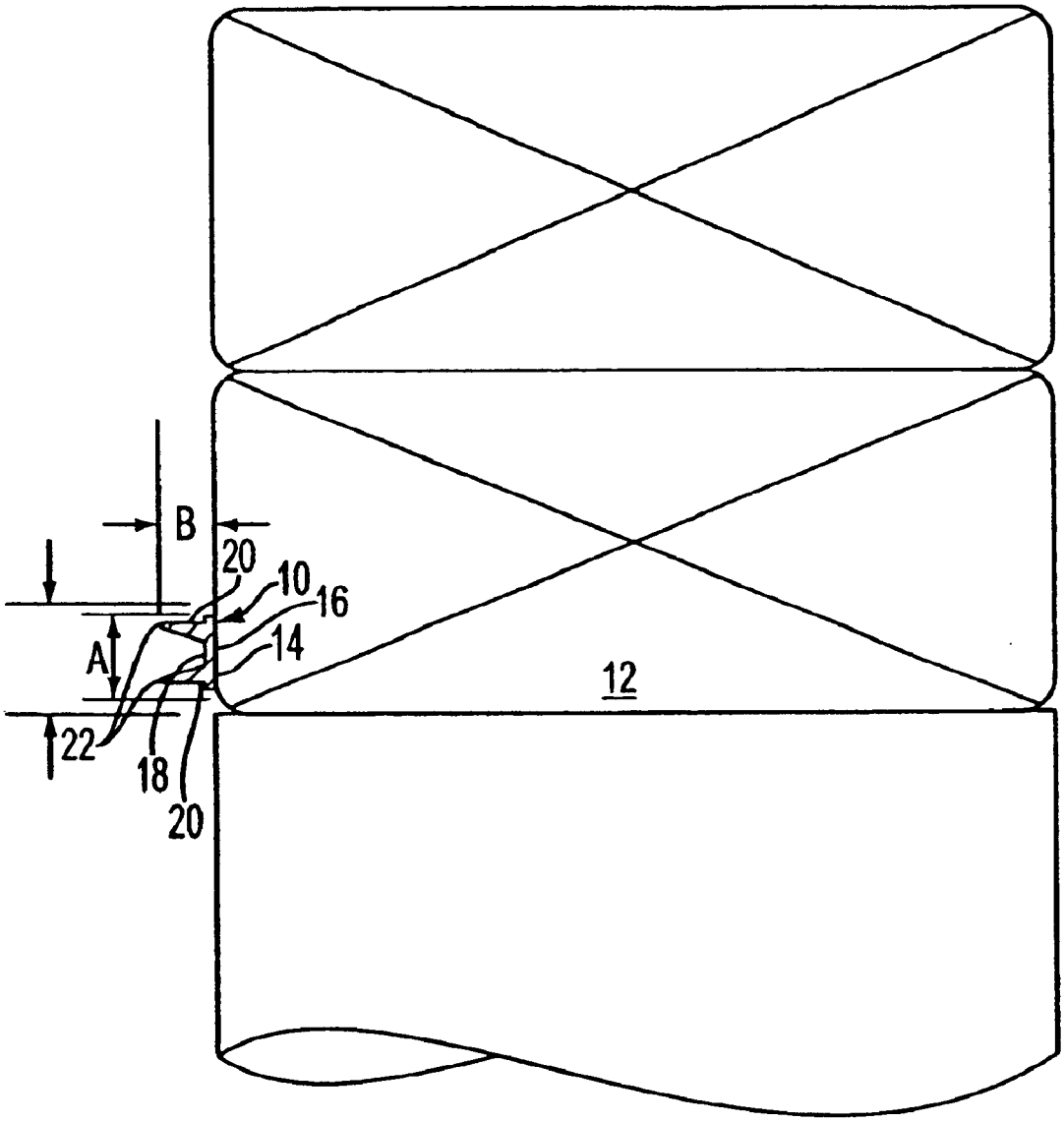
FIG. 1 is an end view of seal structure provided in accordance with the principles of the invention shown secured to a top plate of a wall.
Figure 3:
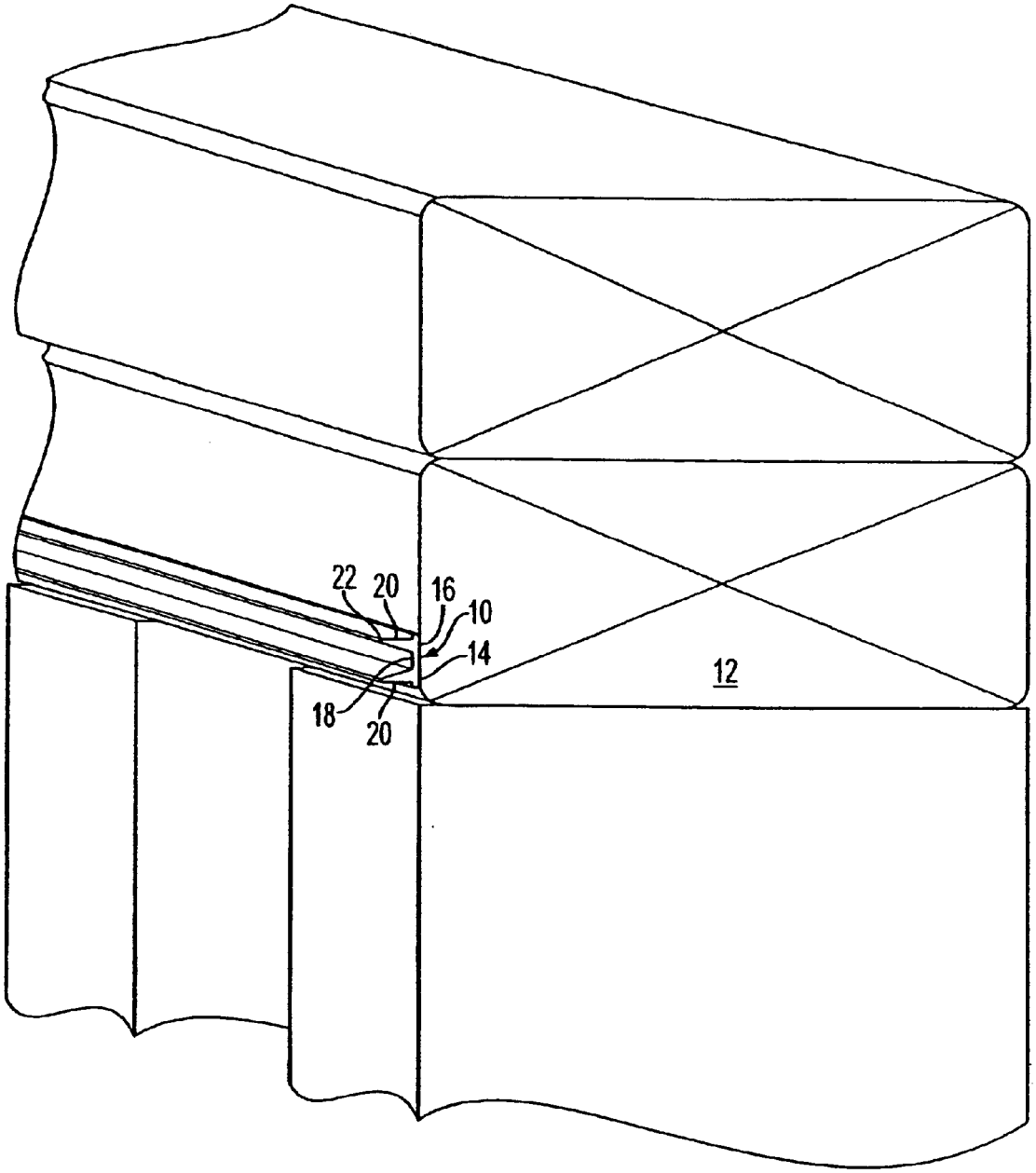
FIG. 3 is a perspective view of the seal structure of the invention shown secured to a top plate of a wall.
Figures 1, 4A:
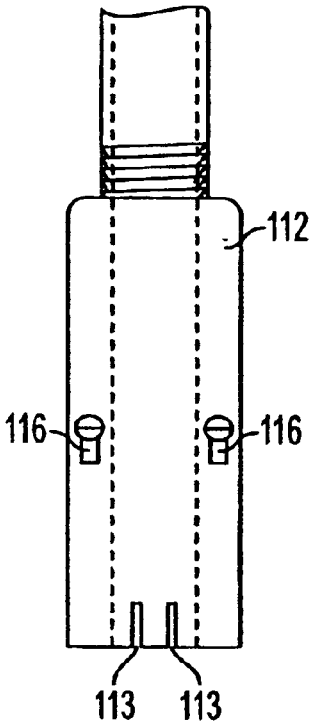
Figures 4, 4A:
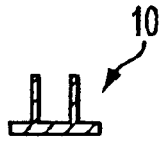
Figures 2, 4A:
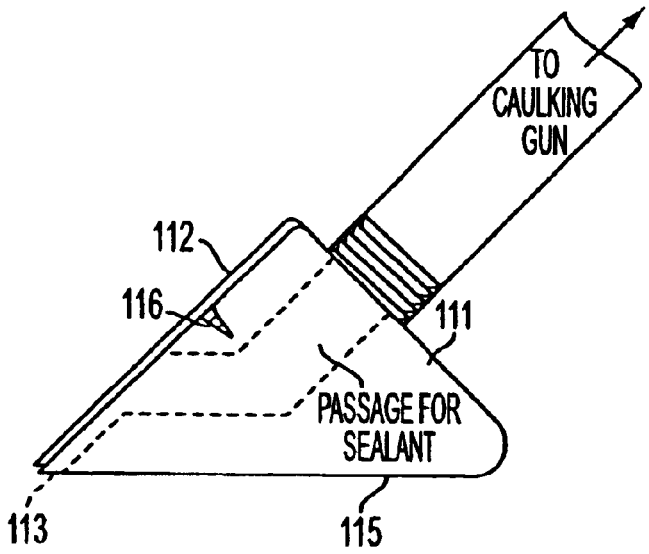
Figures 3, 4A:
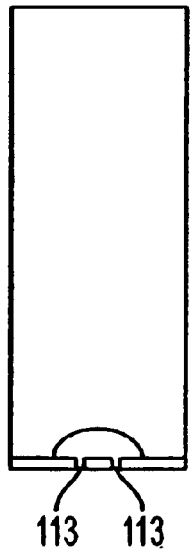
Figures 1, 4B:
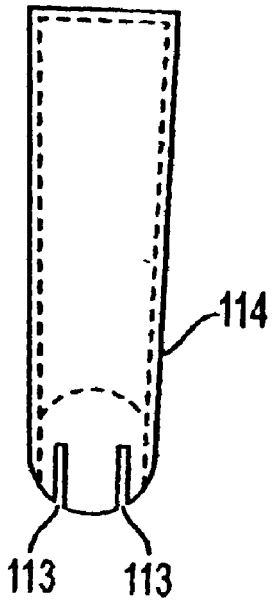
Figures 3, 4B:
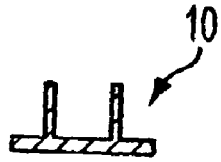
Figures 2, 4B:
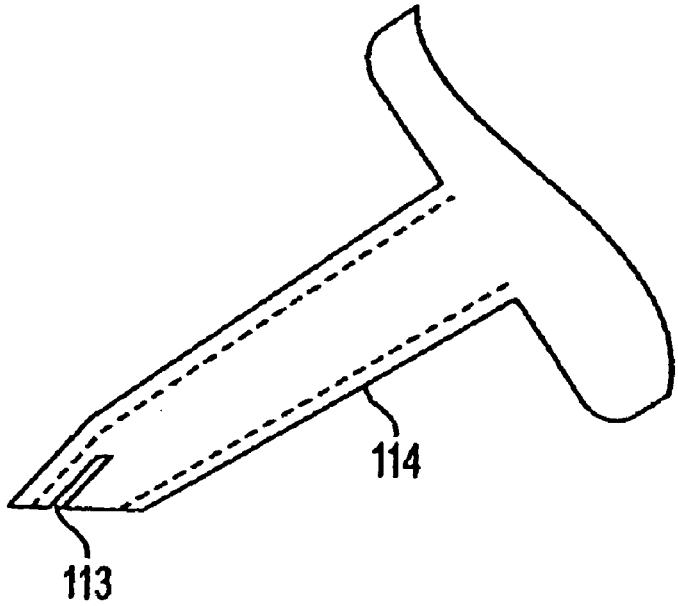

With reference to FIGS. 1 and 3, a seal structure, generally indicated at 10 and provided in accordance with the principles of the present invention, is shown coupled to a top plate or member 12 of a wall. The seal structure 10 is comprised of curable, flowable, non-sag material such as silicone caulk so as to be easily applied, for example, with conventional caulking equipment. The material of the seal structure 10 is preferably a silicone glazing adhesive/sealant which holds it shape without sagging when tooled. The material preferably has a neutral cure with no strong ammonia odor. Neutral cure silicones have an added advantage in that they cure due to atmospheric moisture, and therefore cure rapidly in virtually all temperature ranges experienced at a construction site. A preferred material has a medium modulus, which gives the material approximately 50% or more joint movement capability, exhibits a "skin" in about 5 to about 10 minutes after application, and achieves a full cure in approximately 24 hours (⅜ inch bead at 75° F. and 50% relative humidity). The material forms an extremely tough bond with wood framing members of a home.

A particularly preferred silicone material is the commercially available BOSS 399 (Accumetric). This material contains thixotropic additives which enable the sealant to maintain its shape while it cures. Silicone materials without thixotropic additives tend to slump or self-level. Therefore, preferred silicone materials contain thixotropic additives, so that the standing seal members 20 of the seal structure 10 do not collapse, but stand as formed until they cure. The sag for BOSS 399 according to ASTM C-639 or D-2202 is less than 0.1 inch, which is negligible given the conditions of these tests.

Silicone is also preferred because it exhibits a great deal of elastic memory, which is the ability of a material to, up to its tensil, compression or elongation limits, spring back or recover to its original shape or form. This property is important because it keeps the compressed standing seal members 20 in close contact with the drywall even when framing members warp or as the building structure expands and contracts during the heating and cooling seasons of the year. BOSS 399 can be stretched about 500% and still return to its original shape. Using ASTM D 412, BOSS 399 exhibits a medium modulus, or stiffness, which means that it has a "medium" ability to bend. The modulus is important since the material must be stiff enough to stand erect once formed, and soft enough to allow the standing seal members 20 to bend readily when the drywall slides over them into position. It is also important that the material bend without too much resistance so that when the drywall is installed, it will not stand off from the wall much more than about 1/16 inch even with the seal structure 10 installed behind it. A 1/16 inch standoff is an acceptable dimension in the trades, and imperceptible by even a skilled observer. The material should also have a modulus sufficient to remain firmly in place when drywall installers slide drywall over the seal structure 10 during installation of the drywall.

Other examples of suitable silicone materials include Sil-Flex RTV 7500 Neutral Cure Industrial Silicone (Silco Inc.) and Silicone II (General Electric). While silicone is the preferred material, other caulking materials suitable for use in residential homes and commercial building structures can be used as desired for the particular application, so long as they are capable of forming the seal structure and have properties similar to the silicone caulks described herein after suitable curing. Examples of other caulking materials includes polyurethanes and silicated polyurethanes.

The seal structure 10 is described by exemplary nozzles 111 and 114 as shown in FIGS. 4a1 through 4a4 and 4b1 through 4b3. The nozzles 111 and 114 can be crafted out of any suitable material, such as plastic, rubber or metal, or other suitable materials, depending on whether it is intended for homeowner use in a home, or whether it will be used everyday by a professional installer. The plastic nozzle 114 (FIGS. 4b1 and 4b2) is preferably oval shaped with approximately a 45 degree angle and two vertical slits 113 spaced approximately 0.25 inches apart. Each slit is approximately 0.035 inches wide and approximately 0.19 inches deep. The larger nozzle 111 (FIG. 4a) is a precision metering tip machined with approximately the same dimensions as the plastic nozzle 114. However, the larger nozzle 111 has a larger block 115 which lays flat against the framing lumber to which the seal structure 10 is applied. With either nozzle 111 or 114, when the caulking gun is drawn along the side of the 2×4 top plate, a built-up guide (not shown) can be used to form the seal structure 10 in a straight line. The nozzle 111 includes an adjustable top plate 112, which is secured by screws 116. The plate 112 can be secured by other removable securing structures as desired, such as clamps and clips. The plate 112 can be adjusted to regulate the flow of material and thus provide the desired thickness or height of the body 14. The nozzles 111 and 114 should include an attachment for attaching to a caulk tube or other structure for holding the material for use in forming the seal structure 10.

Figure 2:
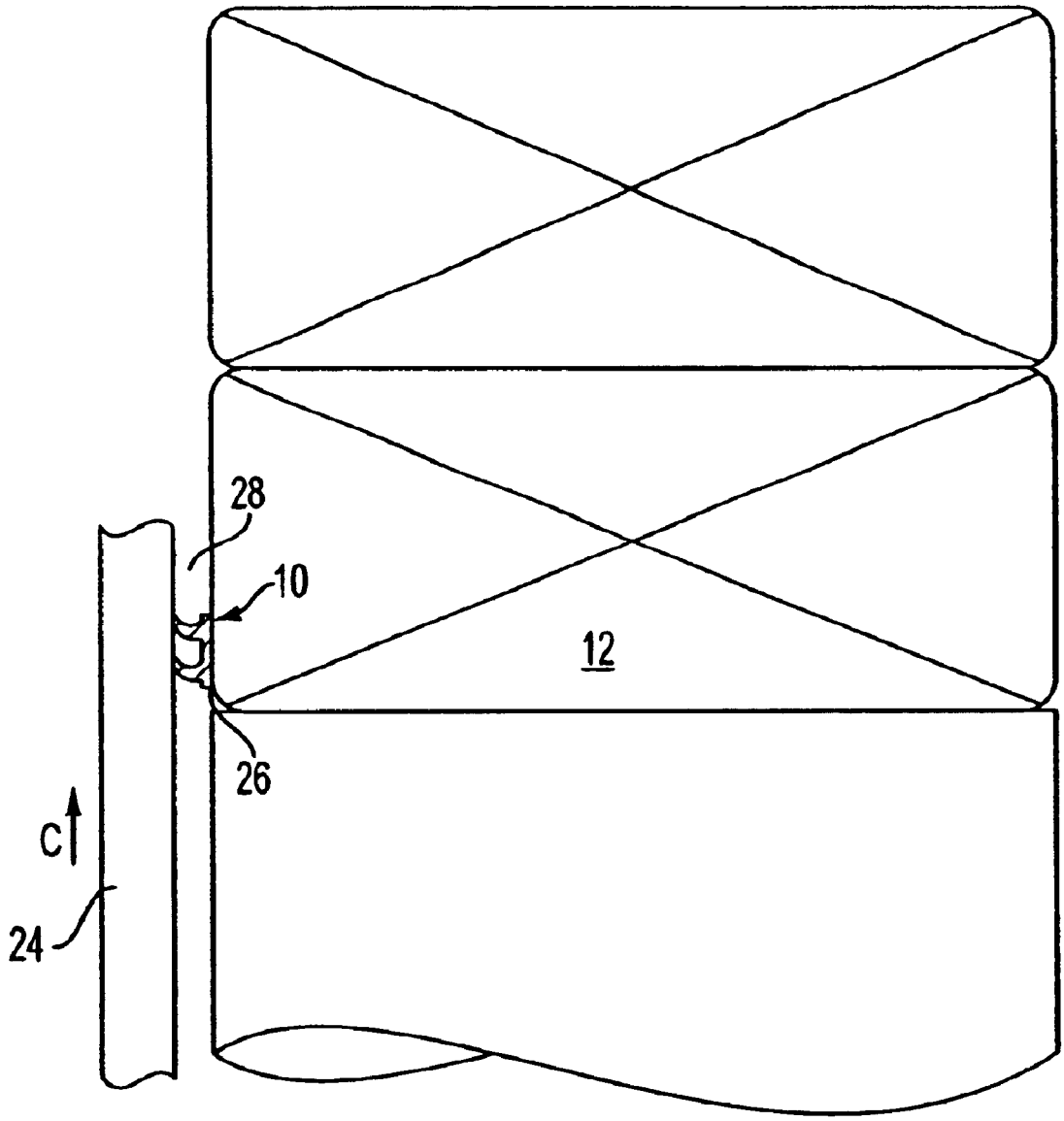
FIG. 2 is an end view of the seal structure of FIG. 1, shown while installing a wallboard with respect to a top plate.
Figure 6:
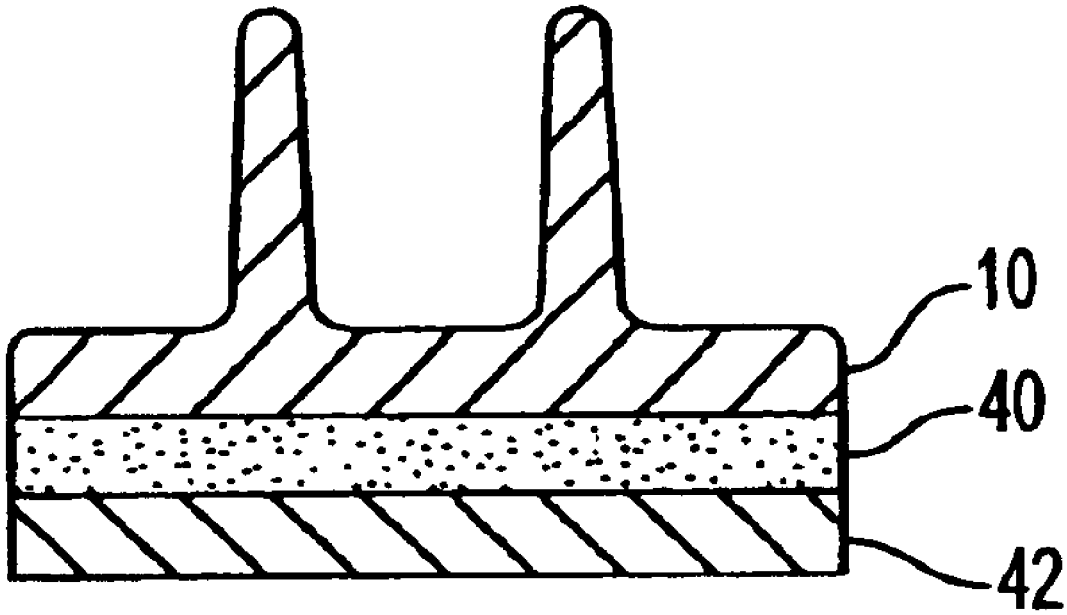
FIG. 6 is an end view of a preformed seal structure having an adhesive backing.

With reference to FIGS. 1 and 2, the shaped nozzles 111 and 114 opening defines the seal structure 10 to have a body 14 including a first surface 16 and an opposing second surface 18. The flowable material is such that the first surface bonds to at least one top plate or member 12. In the illustrated embodiment, the body 14 has a width A of about 0.375 inches. The nozzle opening defines a pair of seal members 20 integral with and extending from the second surface 18 of the body 14. The seal members are disposed in spaced relation and extend a distance B of about 0.19 or about 3/16 inches with respect to the first surface 16 of the body 14. If desired, each seal member 20 can be optionally tapered so as to have a thickness greater near the body 14 than at a distal end 22 thereof so that the seal member 20 is more flexible at a tip thereof, as shown in FIG. 6. The size, number and shape of the slits 113, and corresponding seal members 20, can be varied as desired for the particular application. The preferred number of seal members is 2 or 3. While not preferred, only one seal member 20 can be utilized if desired.

The seal structure 10 should be able to compress to about 1/16 inch under the normal pressure drywall would apply as it is attached to framing members, to provide a standoff for the drywall of about 1/16 inch. To provide sealing of irregular framing member surfaces, the sealing structure 10 should be about 3/16 inch in height before compression by the installed drywall. The sealing structure 10 should have a combination of integrity and resistance such that when drywall is slid over it does not lose integrity and break into pieces or tear loose from the top plate or member 12.

Usually there is more than one top plate 12, as shown in FIG. 2, with two being most common. The seal structure 10 is installed along at least one of the top plates 12 of every wall beneath the attic trusses, on both the interior and exterior walls. Preferably the seal structure 10 is installed on the lower top plate, is installed using caulking equipment, and is permitted to air cure at least 24 hours prior to drywall installation. Alternatively, the seal structure 10 may be pre-formed and may be secured to the top plate by adhesive backing 40 after removing the cover paper 42, shown in FIG. 6, and attaching the seal structure 10 to the desired framing member. The seal structure 10 does not shear loose when a wallboard 24 (FIG. 2) is installed in the direction of arrow C because of the thin, flexible seal members 20 bend upwardly when contacted by the wallboard 24. Thus, the seal structure 10 has no blunt edge for the wallboard 24 to shear as does the conventional caulk bead or weather stripping. The shape of the seal structure 10 creates a double seal between the top plate 12 and the attached wallboard 24 and the resulting dead air space between the flexible seal members 20 forms a tiny "airlock" chamber 26 between the wallboard 24 and the top plate 12. Thus, air leakage and energy loss through the gap 28 between the wallboard 24 and the top plate 12 is virtually eliminated due to design and installation process of the seal structure 10. While two seal members 20 have been shown, the structure 10 can contain a plurality of seal members 20 as desired for the particular application.

Figure 7:
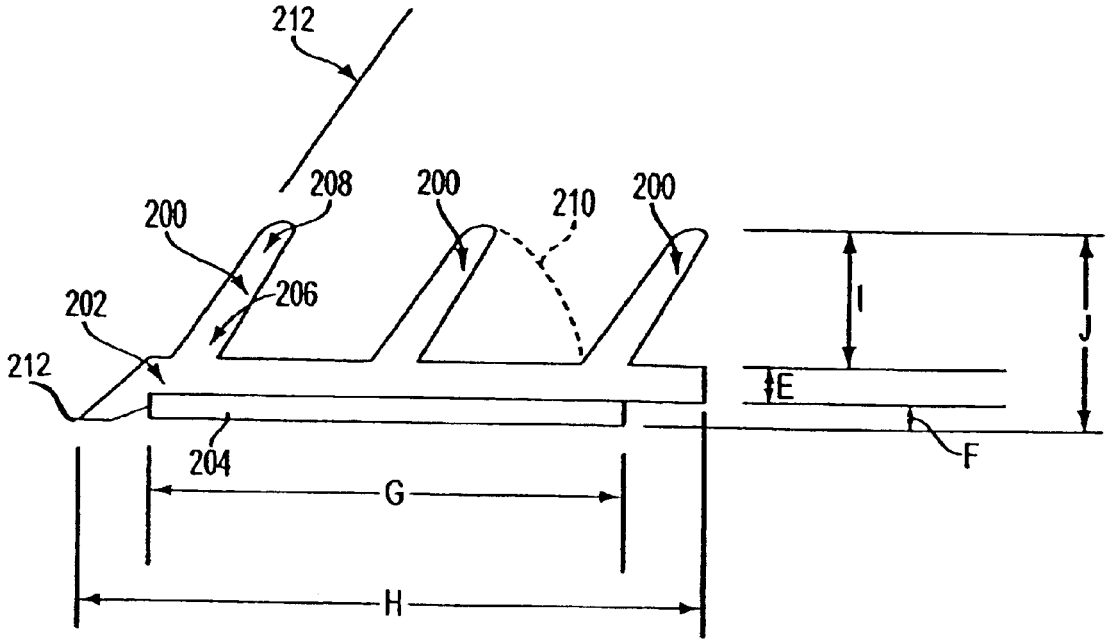
FIG. 7 is an end view of a preformed coextruded seal structure having an adhesive backing.

FIG. 7 shows another example of a pre-formed coextruded seal structure having three standing seal members 200 and a base 202. The seal members 200 are flexible and, thus, formed from a flexible polymeric material, which can compress in a similar manner to the sealing structure 10 described above. The flexible polymeric material should remain flexible after application in order to adjust for movement caused by seasonal temperature changes. A commercially available material that is particularly preferred is Alcryn melt-processible rubber (MPR) having a shore A hardness of approximately 60. The sealing members 200 can be tapered, for example having a thickness of about 3/64 inch at the general area 206 and taper down to about 1/32 inch at the general area 208. The sealing members 200 can also have a uniform thickness, no taper, as shown by the seal members 20 in FIG. 4*a*4. A preferred thickness for a non-tapered sealing member 200 is about 0.020 inch. The sealing members 200 are preferably angled in the direction they flex, shown at 210, for example about 55°, shown at 212. The height of the sealing members 200 is preferably about 0.22 inch, shown at I. Preferably, the height and distance between the sealing members 200 is such that when they are compressed the sealing members 200 form an airlock chamber between each two sealing members 200. In the example of FIG. 7, the distance between the sealing members 200 is about 0.252 inch. The base 202 is preferably a rigid polymeric material, such as PVC (polyvinylchloride). The base 202 has a quicktack foam adhesive tape 204 attached thereto. The base 202 preferably has a thickness of about 0.035 inch, shown at E, and a width of about 0.701 inch, shown at H. The foam adhesive tape 204 preferably has a thickness of about 0.032 inch, shown at F, and a width of about ½ inch, shown at G. The base 202 preferably includes a tapered leading edge shown at 212. The flexible material of the sealing members 200 and rigid material of the base 202 are preferably coextruded. The seal structure can be cut to any desired length strips for easy handling and installation, such as about four foot long. The seal structure is installed before the drywall is installed.

Since the properties, such as flexibility and rigidity, of polymeric materials are now well know, one skilled in the art will easily be able to formulate or acquire commercially available polymeric materials to form the desired flexible sealing members 200 and the rigid base 202. Examples of well known, extrudable polymeric materials include but are not limited to elastomers, rubbers, inorganic polymers such as silicones, and organic polymers such as polyeolefins, polyamides, acrylonitire-butadiene-styrene, poly methlymethacrylate, cellulose acetate butyrate, polycarbonate, polystyrene, polyvinylchloride, polyvinly acetate, polyvinyl alcohol, styrene-acrylonitrile, polyesters, polyoxymethylene, polyformaldehyde, ethylene vinyl acetate copolymer, polyethylene, polyetylene copolymers, polybutylene, polybutylene copolymers, and polypropylene.

Figure 5:
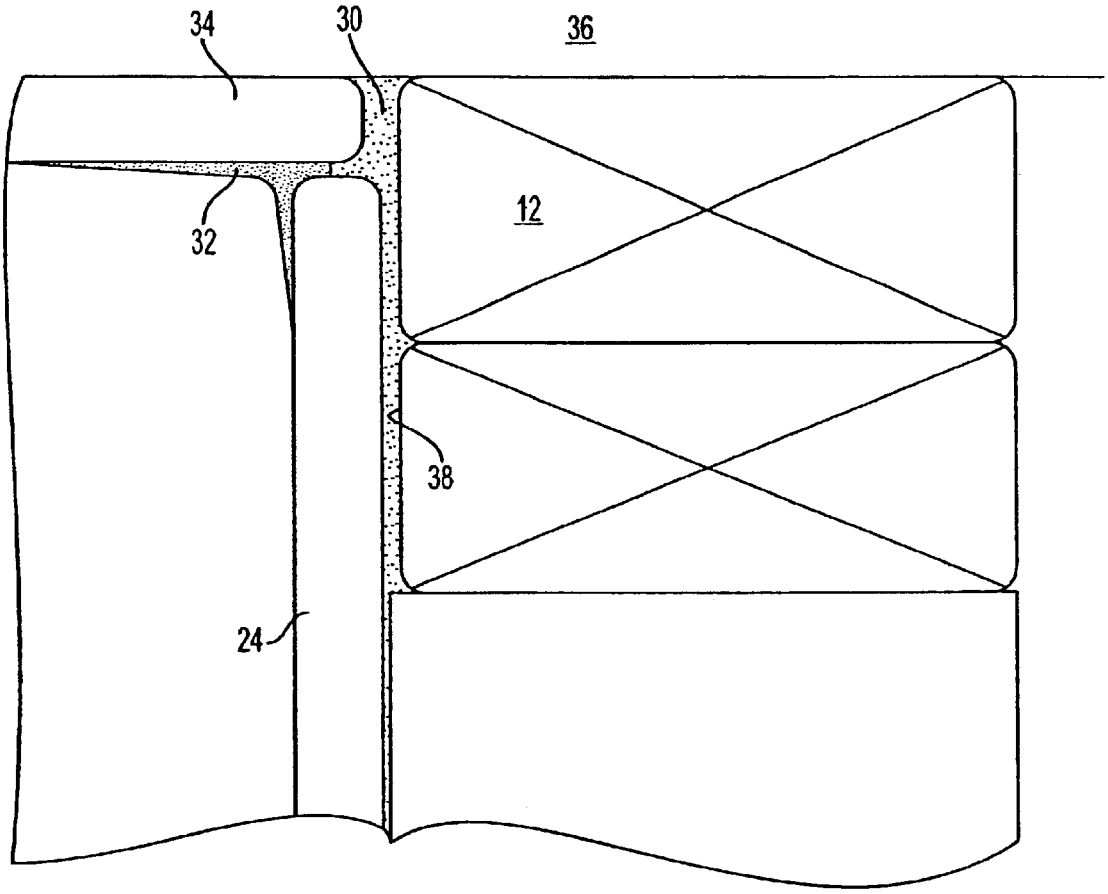
FIG. 5 is an end view of a wallboard and ceiling drywall with a flexible sealant filling an air gap in accordance with another embodiment of the invention.

FIG. 5 shows another embodiment of the invention to seal air gaps between walls of a home under construction after it has been drywalled but before the attic is insulated, or, for an existing home where increased energy efficiency is desired. As shown in FIG. 5, joint compound 32 is provided between the ceiling drywall 34 and the wall board 24. Numeral 36 indicates the ceiling truss. An air gap 38 is present between the wallboard 24, the ceiling drywall 34, the top plate 12 and the ceiling truss 36, usually caused by missalignment between the studs and top plates or subsequent warping of the studs, especially during the first heating season following construction. While the installer is standing in the attic, the installer applies a seal 30 by forcing a high solids, high build elastomeric paint or sealant into each air gap to fill the air gap. Airless spray painting equipment is preferably used to accomplish this task. While the material can be brushed or troweled, penetration into the air gap 38 is usually not nearly as thorough as when sprayed under pressure. The installer sprays the seams on both sides of each wall, pressuring the flexible sealant deeply into the cracks. The elastomeric paint used is preferably an elastomeric acrylic formulation with urethane components and a mixture of ceramics, such as ceramic borosilicates. It should preferably be mold, mildew and algae resistant. Preferably, the elastomeric acrylic formulations also qualify for Class A fire rating and are water based. The elastomeric acrylic formulations are also usually self-priming, so usually only one coat is required. Due to the elastic property, the material stretches when the house moves, and it thoroughly and permanently seals the hundreds of feet of air leaks in one application. In this manner, an entire attic can be air sealed quickly and permanently.

Any suitable elastomeric paint can be used that is capable of sealing a gap of about 1/16 to about ⅛ inch wide and yet has sufficient flexibility to account for normal expansion and contraction during the change of seasons. Examples of suitable elastomeric paints include, but are not limited to: GE-40 Top Coat (Global Encasement, Inc.) which is highly elastomeric; and FS2900 (International Protective Coatings Corp.) which is a fine water-based elastomeric coating with excellent fill qualities. Another example is a silicone caulking material, such as Boss 399, that has been cut or thinned with a suitable solvent to make it sprayable. Thus, it can be appreciated that based on the disclosure provided herein, one of ordinary skill in the art will be able to purchase or formulate a desired elastomeric paint to provide the desired sealing properties for the particular application.

A particularly preferred elastomeric acrylic paint is a blend of about four parts of Ultra Coat Industrial Maintenance Coating (Nationwide Chemical Coating Manufacturers, Inc.) and about one part of Elastomeric Permapatch Waterproofing Caulk & Sealant (Nationwide Chemical Coating Manufacturers, Inc.). When blended accordingly, and sprayed with a powerful airless spray rig, such as the gasoline powered Titan 1200 PowerTwin Series with hydraulic drive, an entire attic can be air sealed quickly and permanently. The ratio of these two sealants is important. Straight (100%) Ultra Coat was found to be too thin to fill exceptionally wide cracks in one coat, but could be used if desired. Straight (100%) Permapatch easily fills wide cracks, but was found to be too thick to force through a long paint supply line necessary to reach from a ground level or truck mounted sprayer into an entire attic. After considerable testing, it was found that a ratio of from about 3 to 4 parts Ultra Coat to about 1 part of Permapatch was sufficiently thick to fill cracks of about 1/16 to about 1/8 inch wide in one pass and still be sprayable with the gasoline powered Titan 1200 PowerTwin sprayer. Since the power of even the most the most powerful paint sprayers varies, a user can easily formulate a thinner or thicker composition by blending commercially available elastomeric paints to provide a formulation having the combination of sufficient solids to fill cracks and a low enough viscosity to be sprayable using the selected spraying equipment.

For existing houses with owners desiring to practice sound energy conservation measures, the attic insulation can be pulled back and the cracks effectively and permanently sealed without having to clean and/or vacuum each top plate as would be necessary to make a hand installed sealant stick to the surfaces. With the seal 30 of this embodiment, a highly flexible sealant is applied under pressure to provide energy savings to the homeowner.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of sealing an airspace between a framing member and wallboard, the method comprising:

forming a seal structure on a framing member, the seal structure comprising an elongated body and at least one seal member integral with and extending generally transversely with respect to a surface of the body, the seal members being flexible and disposed in spaced relation, and placing a wallboard in contact with a distal end of the seal member to define a seal between the wallboard and the framing member.

2. The method according to claim 1, wherein the step of forming the seal structure includes placing a flowable material defining the seal structure on the member and permitting the flowable material to cure prior to placing the wallboard.

3. The method according to claim 1, wherein the flowable material is silicone placed by caulking equipment.

4. The method according to claim 1, wherein said member is a top plate.

5. The method according to claim 1, wherein said step of placing the seal structure includes bonding a preformed seal structure to said framing member using an adhesive.

6. The method according to claim 1, wherein said sealing structure has a height of about 3/16 inch and after fastening wallboard to said framing member said sealing structure can compress to a height of about 1/16 inch, and said sealing structure has sufficient integrity to remain intact when said wallboard is slid over said sealing member during installation of the wallboard.

7. The method according to claim 1, wherein said seal structure comprises at least two seal members.

8. A method of sealing an airspace between a framing member and wallboard, the method comprising:

placing a preformed seal structure on a framing member, the seal structure comprising an elongated body and at least one seal member integral with and extending generally transversely with respect to a surface of the body, the seal member being flexible, and placing a wallboard in contact with a distal end of the seal member to define a seal between the wallboard and the framing member.

9. The method according to claim 8, wherein said sealing structure has a height of about 3/16 inch and after fastening wallboard to said framing member said sealing structure can compress to a height of about 1/16 inch, and said sealing structure has sufficient integrity to remain intact when said wallboard is slid over said sealing member during installation of the wallboard.

10. The method according to claim 8, wherein the body is formed from a rigid polymeric material and the seal member is formed from a flexible polymeric material.

11. The method according to claim 10, wherein said body and seal members are coextruded.

12. The method according to claim 8, further comprising at least two seal members.

13. The method according to claim 12, wherein the seal members are sized and spaced such that under compression an air lock space is formed between compressed seal members.

14. The method according to claim 8, wherein the body has a width of about 0.701 inches and a distance from the first surface of the body to the distal ends of the seal members is about 0.22 inches.

15. The method according to claim 8, wherein the seal member is tapered to have a thickness greater near the body than at the distal end of the wall.

16. The method according to claim 8, wherein the seal member has a uniform thickness.

17. The method according to claim 8, wherein there are three seal members.

18. The method according to claim 8, wherein there are two seal members.

19. The method according to claim 1, wherein said framing member is a top plate.

20. The method according to claim 19, wherein said seal structure is applied to at least one top plate of every wall beneath attic trusses on both interior and exterior walls to reduce leakage of air into an attic.

21. The method according to claim 20, wherein said seal structure is applied to a lower top plate.

22. The method according to claim 20, wherein said seal structure is constructed such that it does not shear off when the wallboard is installed.

23. The method according to claim 22, wherein said seal member is flexible so that it bends when the wallboard is installed to prevent shearing of the seal structure.

24. The method according to claim 8, wherein said framing member is a top plate.

25. The method according to claim 24, wherein said seal structure is applied to at least one top plate of every wall beneath attic trusses on both interior and exterior walls to reduce leakage of air into an attic.

26. The method according to claim 25, wherein said seal structure is applied to a lower top plate.

27. The method according to claim 25, wherein said seal structure is constructed such that it does not shear off when the wallboard is installed.

28. The method according to claim 27, wherein said seal member is flexible so that it bends when the wallboard is installed to prevent shearing of the seal structure.

* * * * *